US005467097A

United States Patent [19]

Toko

[11] Patent Number: 5,467,097

[45] Date of Patent: Nov. 14, 1995

[54] TELESCOPING ANTENNA WITH DUAL IMPEDANCE MATCHING CIRCUITS

[75] Inventor: Yoshio Toko, Hyogo, Japan

[73] Assignee: Mitsubishi Denki Kabushiki Kaisha, Tokyo, Japan

[21] Appl. No.: 181,380

[22] Filed: Jan. 14, 1994

Related U.S. Application Data

[63] Continuation of Ser. No. 851,668, Mar. 16, 1992, abandoned.

[30] Foreign Application Priority Data

Apr. 12, 1991 [JP] Japan ..... 3-106499

[51] Int. Cl.[6] ..... H01Q 1/10; H01Q 1/24

[52] U.S. Cl. ..... 343/702; 343/862; 343/901

[58] Field of Search ..... 343/860–864, 343/702, 900, 901, 903; H01Q 1/10, 1/24

[56] References Cited

U.S. PATENT DOCUMENTS

| | | | |
|---|---|---|---|
| 4,603,333 | 7/1986 | Carlson | 343/903 |
| 4,860,024 | 8/1989 | Egashira | 343/702 |
| 4,862,182 | 8/1989 | Egashira | 343/702 |
| 4,890,114 | 12/1989 | Egashira | 343/702 |
| 4,945,361 | 7/1990 | Egashira | 343/715 |
| 4,958,382 | 9/1990 | Imanishi | 343/702 |
| 5,072,230 | 12/1991 | Taniyoshi et al. | 343/903 |

FOREIGN PATENT DOCUMENTS

| | | | |
|---|---|---|---|
| 120103 | 6/1987 | Japan | H01Q 1/100 |
| 238523 | 10/1990 | Japan . | |

*Primary Examiner*—Michael C. Wimer
*Attorney, Agent, or Firm*—Rothwell, Figg, Ernst & Kurz

[57] ABSTRACT

The present invention relates to the constitution of an antenna for portable wireless apparatus, and has an object to provide an antenna unit capable of operating satisfactorily when the antenna element is extended out of the case and stowed in the case as well. A portion of the antenna element not stowed in an antenna stowage pipe when the antenna is pushed into the plastic case, functions as a radiation element. A portion of the antenna element and an antenna stowage pipe produced of a metal for stowing this portion constitute an impedance stub circuit. Antenna impedances of the antenna element in the extended and stowage positions as well can be made approximately the same by properly setting the length of the antenna element which is stowed in the antenna stowage pipe and the length of the portion not stowed in the stowage pipe.

9 Claims, 8 Drawing Sheets

FIG. 1
(PRIOR ART)
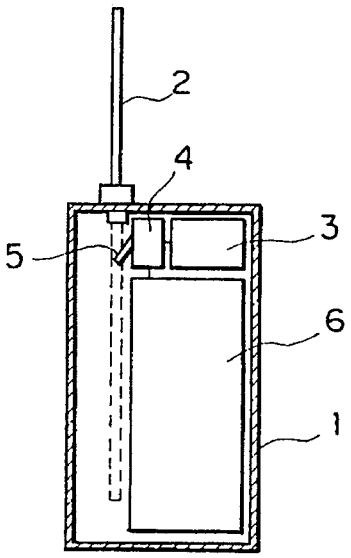
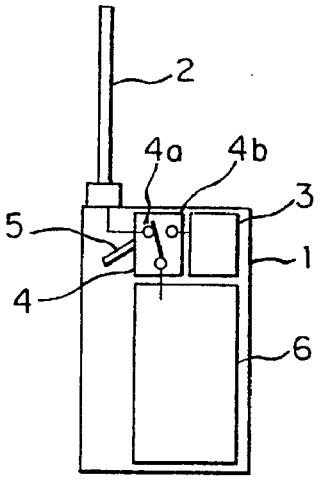
FIG. 2(a) PRIOR ART
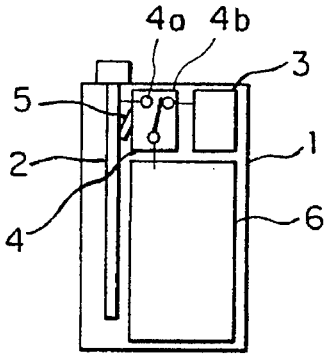
FIG. 2(b) PRIOR ART

TELESCOPING ANTENNA WITH DUAL IMPEDANCE MATCHING CIRCUITS

This is a continuation of application Ser. No. 07/851,668, filed Mar. 16, 1992 now abandoned.

BACKGROUND OF THE INVENTION

1. Field of the Invention

The present invention relates to an antenna unit for portable wireless apparatus to be used primarily within the UHF band.

2. Description of the Prior Art

FIG. 1 is a sectional side view showing a prior-art antenna unit for portable wireless apparatus disclosed in for example Laid-Open Japanese Patent Application No. 42148/86. In this drawing, a numeral 1 refers to a wireless apparatus case; a numeral 2 denotes a telescopic whip antenna mounted in the wireless apparatus case 1; a numeral 3 represents a small antenna built in the wireless apparatus case 1; a numeral 4 is a high-frequency switch for switching between the whip antenna 2 and the small antenna 3; a numeral 5 refers to a contact changeover lever of the high-frequency switch 4, which is opened outward by the force of a spring when the whip antenna is pulled out, connecting the switch contact 4*a* to a receiving-transmitting circuit 6 as shown in FIG. 2, and also connecting the switch contact 4*a* to the receiving-transmitting circuit 6 when the whip antenna 2 is pushed into the wireless apparatus case 1. A numeral 6 refers to a receiving-transmitting circuit which is changed over from the whip antenna 2 to the small antenna 3 or vice versa by means of the high-frequency switch 4.

Next, the operation of this wireless apparatus will be explained. For communication with a remote station or in such a place where the condition of reception is poor, the whip antenna 2 is pulled out of the wireless apparatus case 1, being in the state shown in FIG. 2(*a*). Then the contact changeover lever 5 becomes free to connect the whip antenna 2 to the receiving-transmitting circuit 6 via the contact 4*a* of the high-frequency switch 4, thereby enabling good communication through the whip antenna 2. For short-range communication, or during waiting after completion of communication, the whip antenna 2 is pushed into the wireless apparatus case 1, being stowed in the position indicated by a dotted line in FIG. 1. In this case, as shown in FIG. 2(*b*), the contact changeover lever 5 is pressed by the whip antenna 2 thus stowed, connecting the built-in small antenna to the receiving-transmitting circuit 6 via the contact 4*b* of the high-frequency switch 4. Thus communication is made through the built-in small antenna, enabling reception of an emergency call signal and sufficient communication with a short-range counterpart wireless station in a place where high radio field intensity is present.

Since the prior-art antenna unit for portable wireless apparatus has the above-described constitution, it is necessary to provide a space for mounting the small antenna 3 in the wireless apparatus case 1. The provision of this space, however, will become an obstacle to the miniaturization of wireless apparatus. In addition, the prior art has such a problem that the adoption of the small antenna 3 and high-frequency switch 4 is costly and its reliability will decrease with an increase in the number of use of the high-frequency switch.

SUMMARY OF THE INVENTION

The present invention has been accomplished in an attempt to solve the problems mentioned above. And it is an object of this invention to provide an antenna unit which is capable of functioning as an antenna without using a small antenna and a high-frequency switch even when a whip antenna is in a stowage position.

The antenna unit of the present invention is characterized in that the antenna element, when stowed in the wireless apparatus case, is partly insulated from an electrically conductive pipe, and the electrically conductive pipe is connected to a reference potential such as a ground potential.

Another antenna unit embodied in the present invention features that the antenna element thereof, when stowed in the case, is partly insulated from the electrically conductive pipe, the electrically conductive pipe is connected to the reference potential such as the ground potential, and the position of connection is adjustable.

The conductive pipe and a part of the antenna element constitute an impedance stub. The part of the antenna element not stowed in the conductive pipe functions as a radiation element of the antenna, thus enabling impedance matching between the part of the antenna not stowed in the conductive pipe and the wireless apparatus body and also preventing the lowering of antenna efficiency that would otherwise occur by improper impedance matching. In consequence, the antenna operates satisfactorily when the antenna is extended out of, and stowed in, the case.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 1 is a sectional side view of a prior-art antenna unit;

FIG. 2, FIG. 2*a* and FIG. 2*b* are explanatory view for explaining the function of a high-frequency switch;

DETAILED DESCRIPTION OF THE PREFERRED EMBODIMENTS

Figure 3:
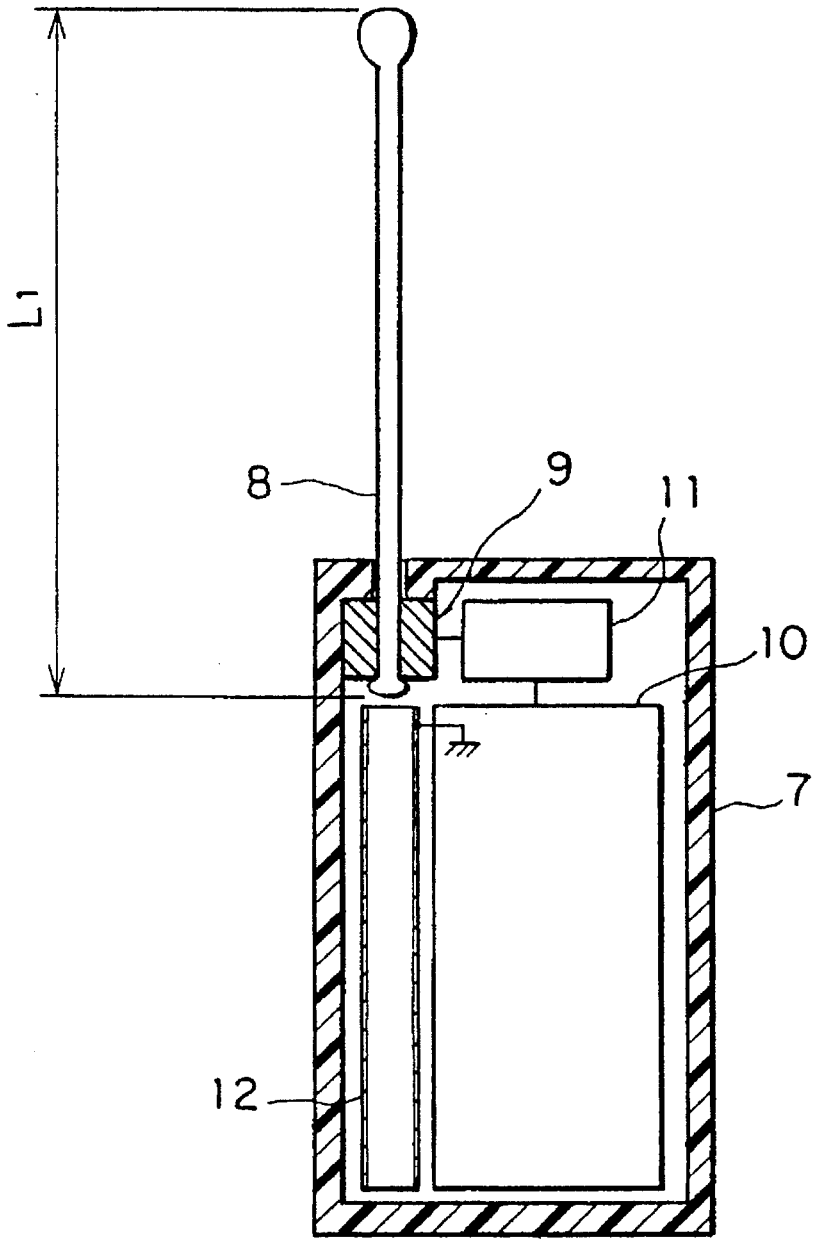
FIG. 3 is a sectional side view showing a first embodiment of an antenna unit according to the present invention with the antenna extended.
Figure 4:
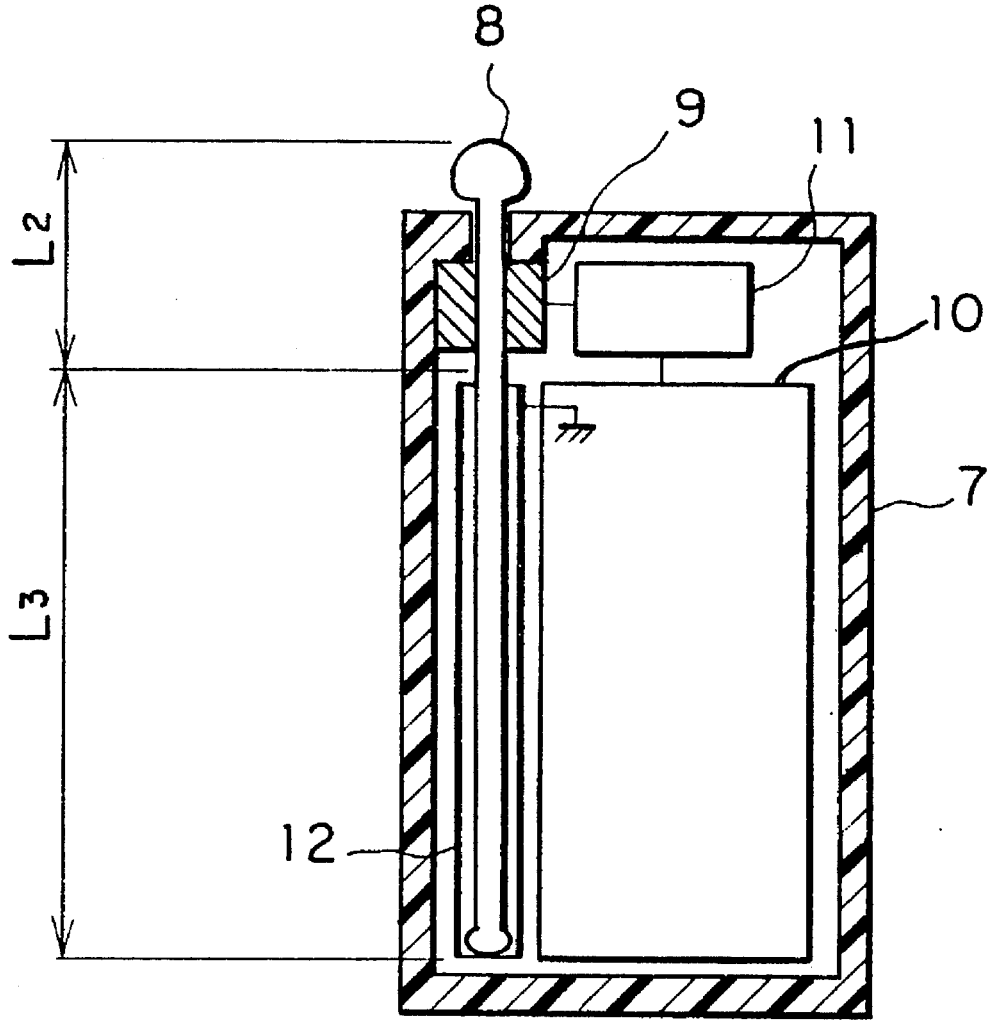
FIG. 4 is a sectional side view showing the first embodiment of the antenna unit according to the present invention with the antenna stowed in the case.
Figure 5:
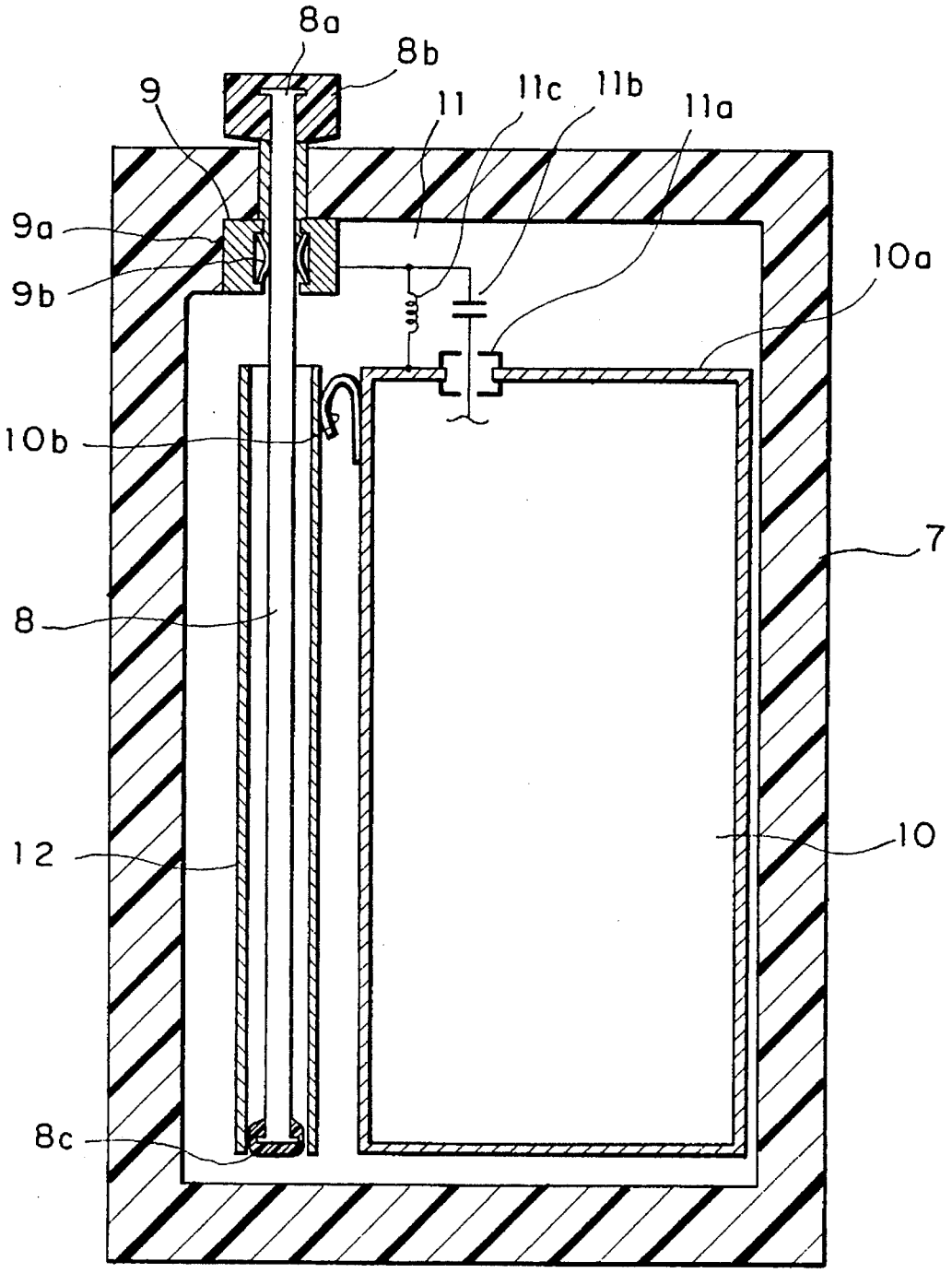
FIG. 5 is a sectional side view showing in detail the first embodiment of the antenna unit according to the present invention.

FIGS. 3 to 5 show a first embodiment of the antenna unit according to the present invention. In FIG. 3, a numeral 7 denotes a plastic case of the wireless apparatus; a numeral 8 refers to a rod antenna element used as a whip antenna of the length $L_1$ which can be extended out of, and pushed in, the plastic case; a numeral 9 refers to an antenna feeding section in contact with the antenna element 8; a numeral 10 refers to a wireless apparatus body including a receiving-transmitting circuit housed in the plastic case, and enclosed with a metal case as described later. A numeral 11 is an impedance matching circuit provided between the wireless apparatus body 10 and the antenna feeding section 9; and a numeral 12 represents an antenna stowage pipe produced of metal for stowing the antenna element 8, and grounded through the metal case of the wireless apparatus body 10. FIG. 4 is a sectional side view of the antenna unit with the antenna element 8 of FIG. 3 stowed in the case 7.

FIG. 5 is a sectional side view showing the antenna unit embodied in the present invention in FIG. 4, in which a numeral 8*a* is an electrically conductive part located in the upper part of the antenna element 8; a numeral 8*b* denotes a plastic cap covering the electrically conductive part 8*a;* a numeral 8*c* refers to a plastic stopper covering the lower part of the antenna element 8; a numeral 9*a* refers to an antenna feeding section provided in the plastic case 7; a numeral 9*b* is an elastic member connecting the antenna feeding section 9*a* with the antenna element 8; a numeral 11*a* is a matching circuit feeding terminal; a numeral 11*b* expresses a capacitor; a numeral 11*c* is a coil; a numeral 10*a* is a metal case covering the wireless apparatus body 10; and a numeral 10*b* represents a bent plate-like stub tuning spring as a means for connecting the metal case 10*a* with the antenna stowage pipe 12.

In the following the operation of this antenna unit will be explained. In the state shown in FIG. 3, with a change in the length $L_1$ of the antenna element 8, the impedance viewed from the antenna feeding section 11 varies as roughly indicated by a dotted line a in FIG. 6. For example, when $L_1$ of a value from $(1/4)\lambda$ to $(1/2)\lambda$ ($\lambda$: Radio frequency wavelength) is selected, the impedance will come near the point A (the area near the point A is represented by the point A for brevity). In the meantime, in the state shown in FIG. 4, if the portion of the length $L_2$ is taken out, with the length $L_3$ of the antenna element 8 covered with the antenna stowage pipe 12 disregarded, the value of impedance as viewed from the antenna feeding section 11 comes to the vicinity of the point B in FIG. 6 when the length $L_2$ of about $(1/10)\lambda$ is selected.

Here, there is established a relationship between $L_1$ and $L_2$ which equalizes the resistance component of impedance in the state shown in FIG. 3 to the resistance component of impedance with the portion of the length $L_3$ disregarded in the state shown in FIG. 4. That is, both the resistance components of these impedances can be made equal when $L_1$ and $L_2$ are properly selected. In the meantime, when the upper part of the antenna stowage pipe 12 contacts the metal case 10*a* through the stub tuning spring 10*b*, the stub circuit is formed by the portion of the length $L_3$ of the antenna element 8 and the antenna stowage pipe 12 when the antenna is stowed in the case. When the antenna element 8 and the antenna stowage pipe 12 are insulated by the plastic stopper 8*c*, an open stub is formed. In this state, when $L_3$ is varied, the impedance at only the length $L_2$ of the antenna element 8 indicated at the point B varies on the line b indicating the resistance component of FIG. 6. That is, when the length of $L_3$ is selected properly, the impedance is changed from the value at the point B to that at the point A.

Figure 6:
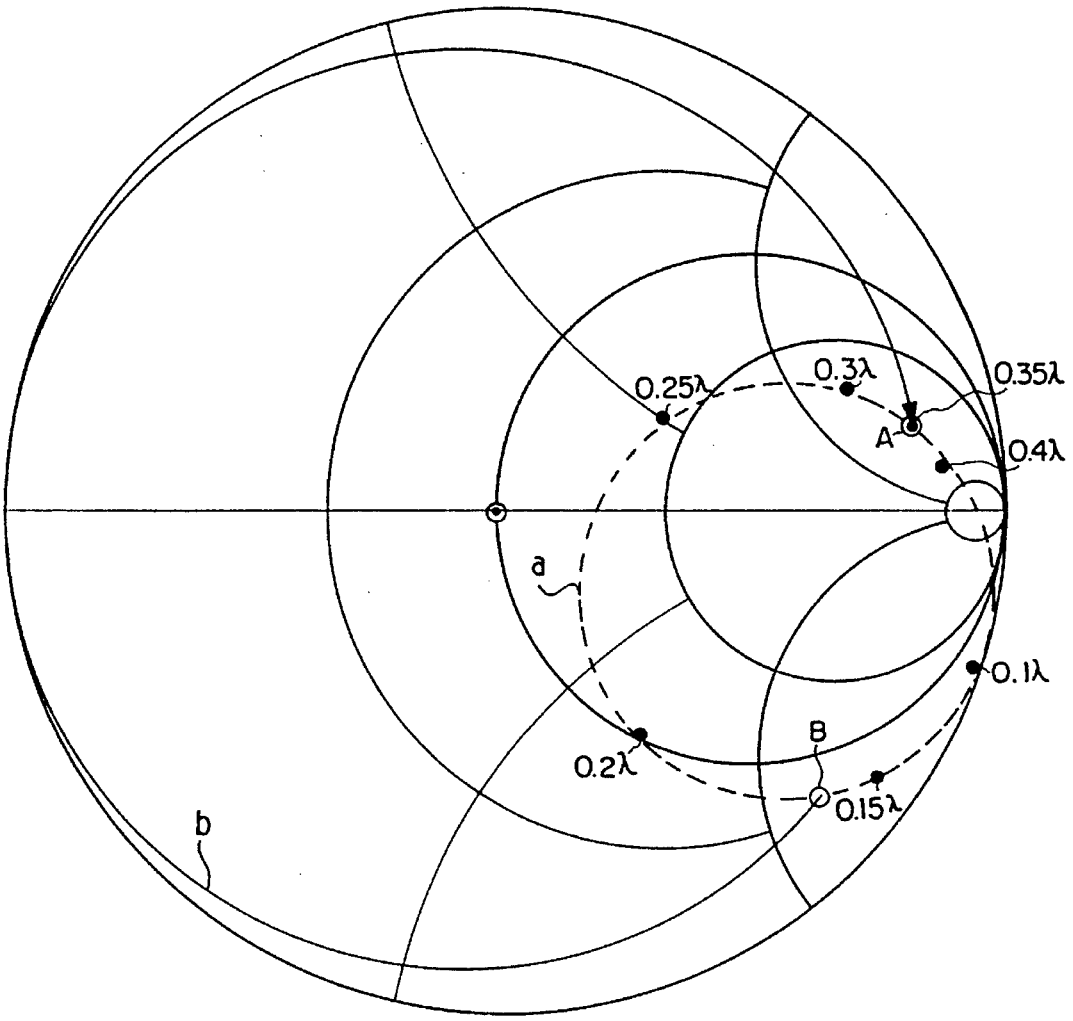
FIG. 6 is a Smith chart showing antenna impedance characteristics of the first embodiment of the antenna unit according to the present invention.

Theoretically, as described above, it is possible to set, to the value of the point A of FIG. 6, both the antenna impedance as viewed from the antenna feeding section 9 with the antenna element 8 pulled out as shown in FIG. 3 and the impedance as viewed from the antenna feeding section 9 with the antenna element 8 stowed as shown in FIG. 4. In this state, the impedance of the wireless apparatus feeding section of the wireless apparatus body 10 and the antenna impedance are matched by the impedance matching circuit 11. Accordingly, the power can efficiently be fed, without a loss caused by mismatching, by means of a first impedance matching circuit 11 when the antenna is in an extended position and in a stowed position as well. As explained above, the stub circuit thus forms a second impedance matching circuit for matching, together with the first impedance matching circuit 11, the impedance of the antenna element which is not stowed in the stowage pipe 12 when the antenna element is in the retracted position.

In FIG. 5, the elastic member 9*b* is used to always maintain electrical continuity between the telescoping antenna element 8 and the antenna feeding section 9. The impedance matching circuit 11 consists of the matching circuit feeding terminal 11*a*, the capacitor 11*b* and the coil 11*c*. The antenna stowage pipe 12 is made of a tubular metal pipe. At the bottom end of the antenna element 8 is provided the plastic stopper 8*c* composed of an insulator for holding the antenna element 8 at the center of the pipe 12 as well as for providing insulation between the antenna stowage pipe 12 and the antenna element 8 when the antenna element 8 is in the stowage position.

Figure 7:
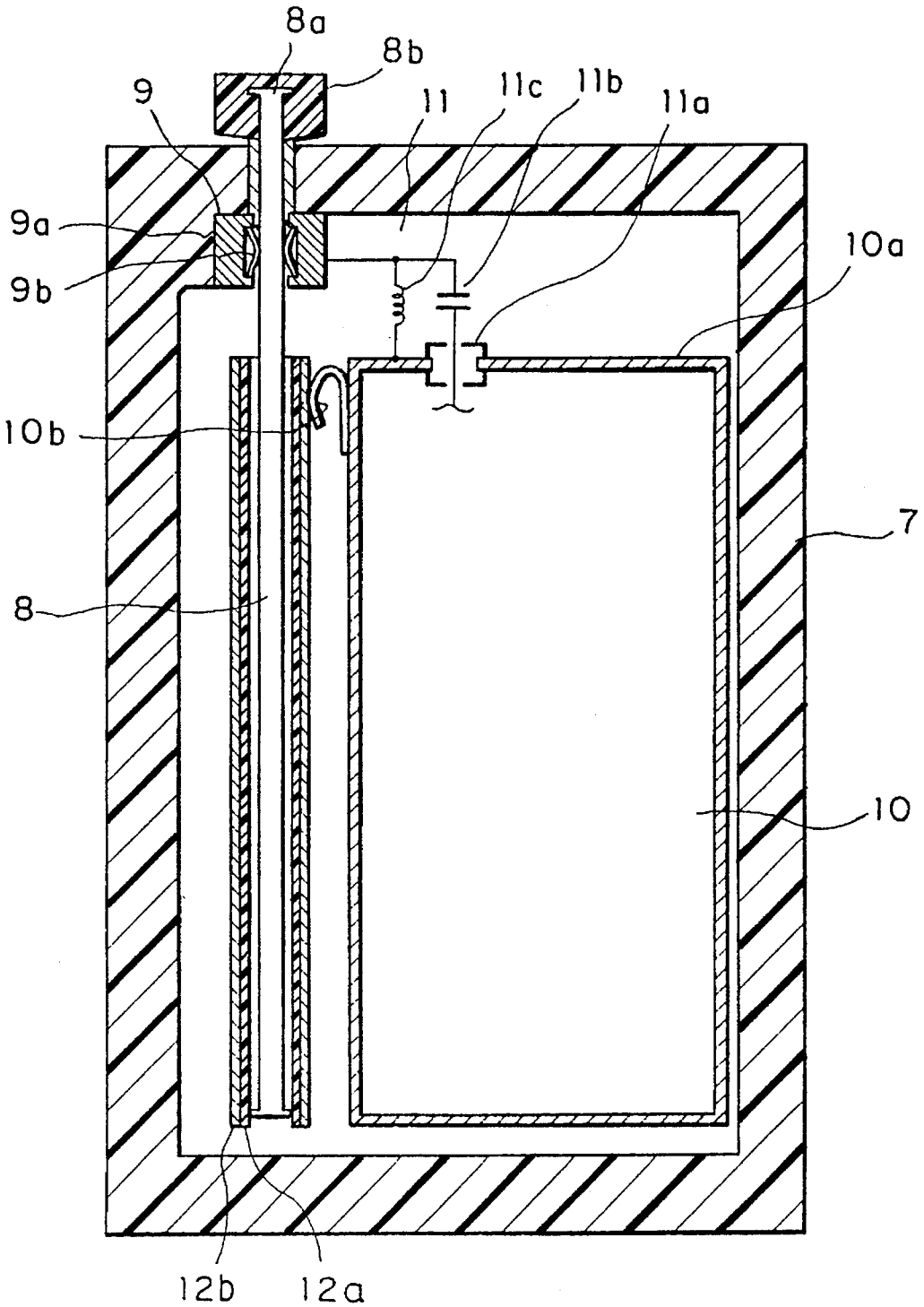
FIG. 7 is a sectional side view showing a second embodiment of the antenna unit according to the present invention.

In the example described above, the metal pipe is used for the antenna stowage pipe 12, but a plastic pipe 12*a* coated on the outside surface with a conductive coating 12*b* as shown in the second embodiment in FIG. 7 may be used. In this case, the device is light in weight as compared with that using the metal pipe, and besides it is unnecessary to use the plastic stopper 8*c* for the provision of insulation between the antenna element 8 and the antenna stowage pipe 12 shown in FIG. 5. Further, the metal antenna stowage pipe 12 may be coated on the inner wall with an insulating paint. In this case also, the use of the plastic stopper 8*c* becomes unnecessary.

Figure 8:
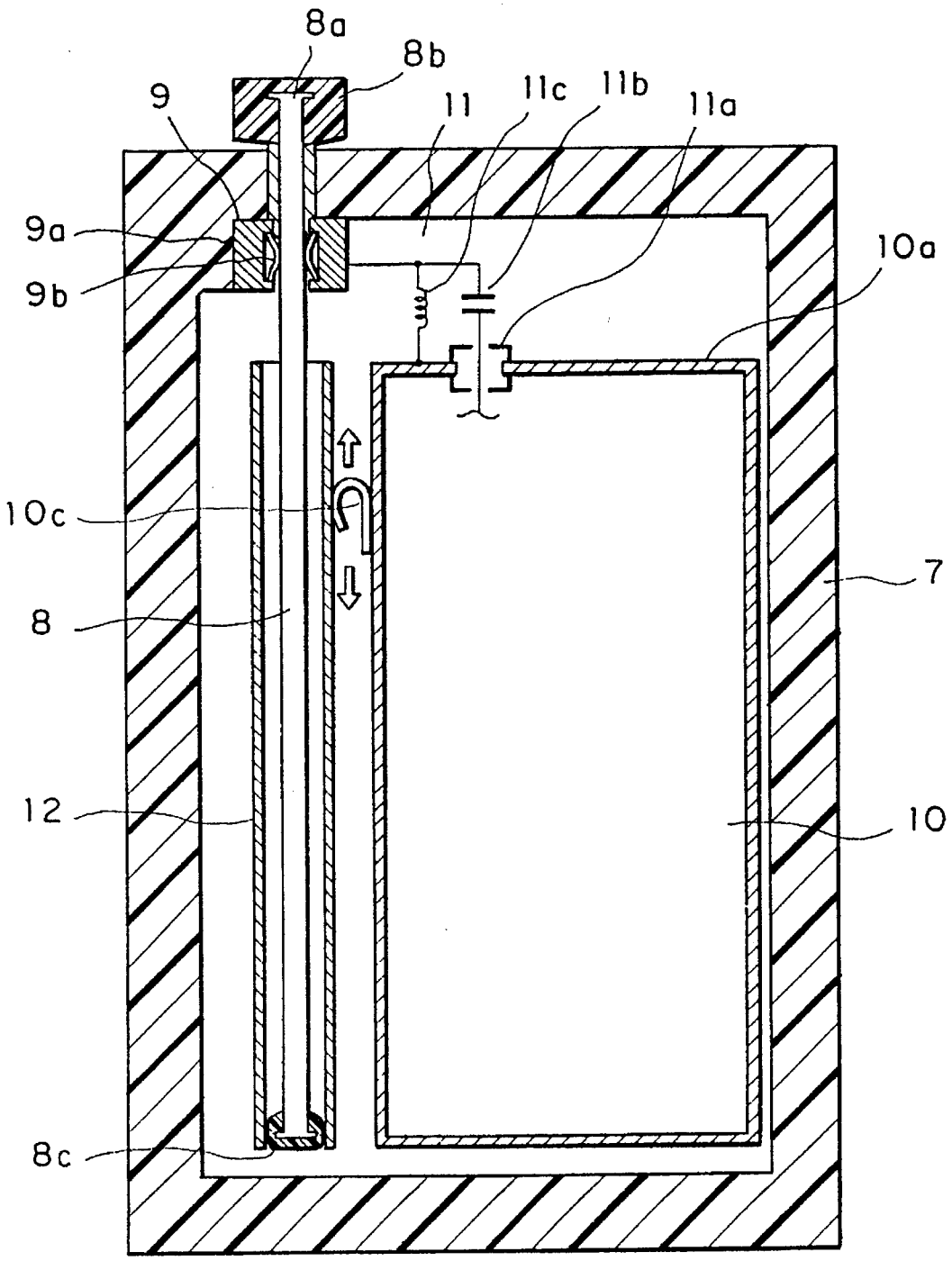
FIG. 8 is a sectional side view showing a third embodiment of the antenna unit according to the present invention.

In the first and second embodiments the stub tuning spring 10*b* is installed in contact with the top end section of the antenna stowage pipe 12, but in the third embodiment, as shown in FIG. 8, another state of contact of these parts is shown. That is, the stub tuning spring 10*c* may be installed in a position a little below the top end as shown in FIG. 8 for the purpose of insuring optimum impedance matching when the antenna is in the stowage position. Further a slidable stub tuning spring 10*c* as indicated by an arrow may be adopted. And further, where cost reduction takes precedence, the pipe 12 may be soldered directly to the wireless apparatus body 10, not using an elastic sheet such as the spring 10*c*.

In each of the embodiments described above, the impedance matching circuit 11 using the capacitor 11*b* and the coil 11*c* was shown, but the impedance matching circuit 11 of any optional circuit formation may be adopted in accordance with the impedance of the feeding section of the wireless apparatus. Further the impedance matching circuit 11 may be installed inside the metal case 10*a* of the wireless apparatus body.

Figure 9:
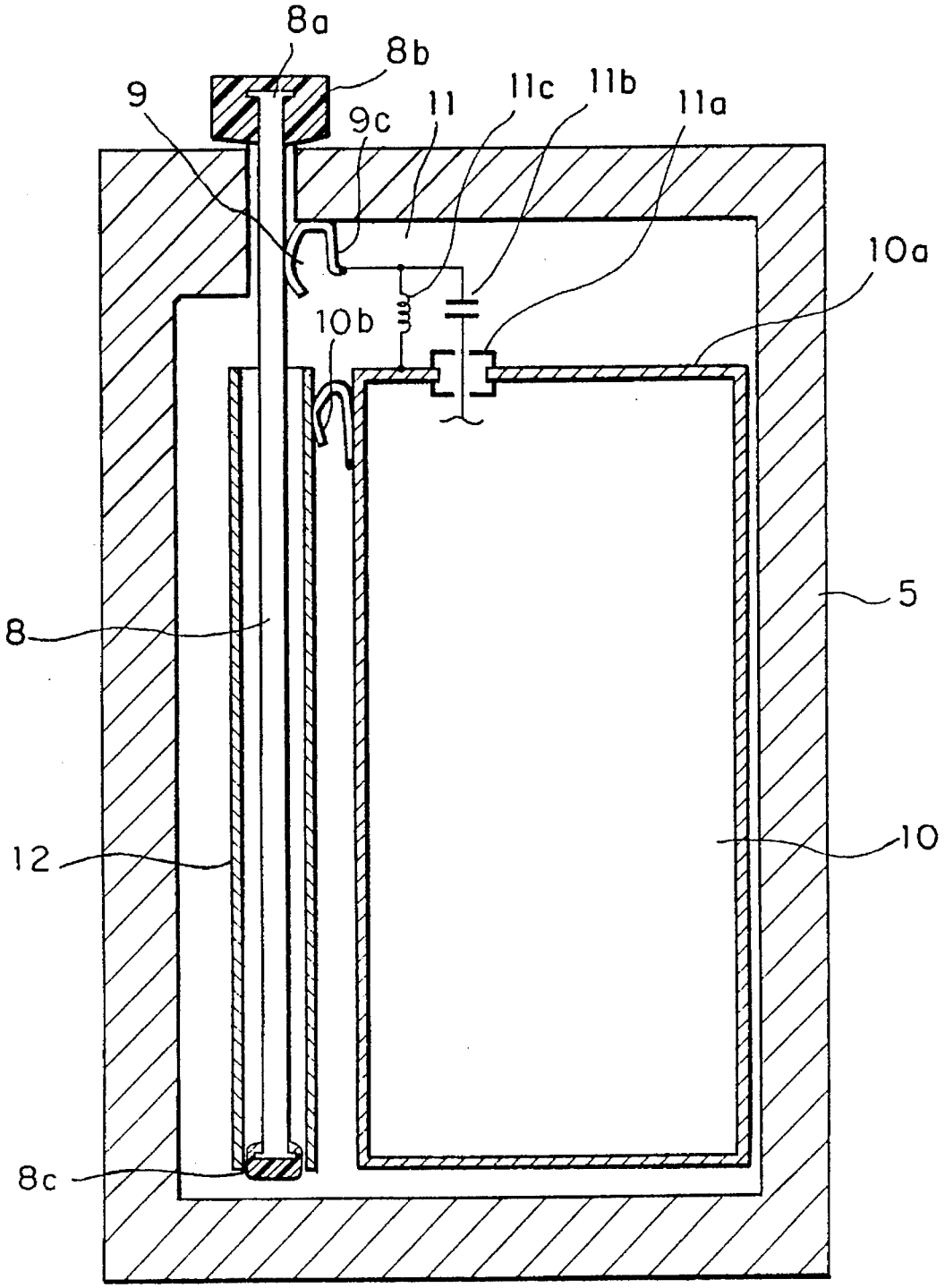
FIG. 9 is a sectional side view showing a fourth embodiment of the antenna unit according to the present invention.

FIG. 9 is a sectional side view showing the fourth embodiment of the antenna unit according to the present invention. In this case, the antenna feeding section 9*a* is not used, but a bent sheet-like elastic member 9*c* is fixed directly on the plastic case 7, and is in elastic contact with the antenna element 8, thereby enabling the reduction of cost and weight of the apparatus.

According to the above-described antenna unit in which the impedance stub is formed by a part of the antenna element in the stowage position and the antenna stowage pipe and the other part of the antenna element works as a radiation element, it is unnecessary to provide an independent built-in antenna, and only a single antenna element functions satisfactorily as an antenna regardless of its position, that is, when stowed as well as when extended.

While only certain embodiments of the present invention have been described, it will be apparent to those skilled in the art that various changes and modifications may be made therein without departing from the spirit and scope of the present invention as claimed.

What is claimed is:

1. An antenna unit, comprising: a case for housing a wireless apparatus body section including a receiving-transmitting circuit; an antenna element extendibly mounted in said case for movement between an extended position and a stowed position and connected with said receiving-transmitting circuit in said wireless apparatus body section through a first impedance matching circuit and an antenna feeding section, said first impedance matching circuit providing an impedance match for matching the impedance of said antenna element in said extended position with said receiving-transmitting circuit; a conductive antenna stowage pipe for holding said antenna element with said antenna element being insulated from said stowage pipe when said antenna element is stowed in said case; and a connecting means for connecting said antenna stowage pipe to a reference potential; wherein, when said antenna element is stowed in said case, the part of said antenna element stowed in said stowage pipe and said antenna stowage pipe constitute a stub circuit forming a second impedance matching circuit for matching, together with said first impedance matching circuit, the impedance of said antenna element not stowed in said antenna stowage pipe with said receiving-transmitting circuit; and the other part of said antenna element not stowed in said antenna stowage pipe functions as a radiation element when fed with power through said antenna feeding section; and the whole of said antenna element, when extended from said case, is impedance-matched with said receiving-transmitting circuit by said first impedance matching circuit and functions as a radiation element when fed with power through said antenna feeding section.

2. The antenna unit as claimed in claim 1, wherein the length of a portion of said antenna element extended out of a case and functioning as a radiation element, the length of a portion of said antenna element stowed in said case and functioning as a radiation element, and the length of a portion of said antenna element stowed in an antenna stowage pipe, satisfy such a relation that impedance on the radiation element side as viewed from an antenna feeding section with said antenna element extended out of said case and impedance on the radiation element side as viewed from said antenna feeding section with said antenna element stowed in said case become equal.

3. The antenna unit as claimed in claim 1, wherein a non-conductive stopper covering the bottom end of said antenna element insures insulation between said antenna element and said antenna stowage pipe.

4. The antenna unit as claimed in claim 1, wherein a connecting means is provided with a bent sheet-like elastic member interposed between an outside wall of said antenna stowage pipe and an outside wall of said wireless apparatus body section and is in contact with both said outside walls.

5. The antenna unit as claimed in claim 4, wherein said sheet-like elastic member is provided movable in the same direction of movement of said antenna element between said outside wall of said antenna stowage pipe and said outside wall of said wireless apparatus body section.

6. The antenna unit as claimed in claim 1, wherein said conductive antenna stowage pipe has a conductive outside wall and an insulated inside wall.

7. The antenna unit as claimed in claim 6, wherein said antenna stowage pipe is a plastic pipe coated on the outside surface with a conductive paint.

8. An antenna unit, comprising: a case for housing a wireless apparatus body including a receiving-transmitting circuit; an antenna element extendibly mounted in said case for movement between an extended position and a stowed position, and connected with said receiving-transmitting circuit in said wireless apparatus body through a first impedance matching circuit for matching the impedance of said antenna element in said extended position with said receiving-transmitting circuit; a conductive antenna stowage pipe for stowing said antenna element with said antenna element being insulated from said stowage pipe when said antenna element is stowed in said case; and a connecting means for connecting said antenna stowage pipe with a reference potential wherein, when said antenna element is stowed in said case, the portion of said antenna stowed in said antenna stowage pipe and said antenna stowage pipe constitute a stub circuit forming a second impedance matching circuit for matching, together with said first impedance matching circuit, the impedance of said antenna element not stowed in said antenna stowage pipe with said receiving-transmitting circuit, and the portion of said antenna element not stowed in said antenna stowage pipe functions as a radiation element when fed with power; and when said antenna element is extended out of said case, the whole of said antenna element is impedance-matched with said receiving-transmitting circuit by said first impedance matching circuit and functions as a radiation element when fed with power.

9. The antenna unit as claimed in claim 8, wherein said antenna element is connected with said first impedance matching circuit by a bent sheet-like elastic member elastically engaging said antenna element.

* * * * *